United States Patent [19]

Ferris

[11] 4,216,610

[45] Aug. 12, 1980

[54] POP-UP TOY

[75] Inventor: Michael J. Ferris, Chicago, Ill.

[73] Assignee: Marvin Glass & Associates, Chicago, Ill.

[21] Appl. No.: 6,449

[22] Filed: Jan. 25, 1979

[51] Int. Cl.[3] ..... A63H 29/16

[52] U.S. Cl. ..... 46/44; 46/145

[58] Field of Search ..... 46/44, 116, 119, 145, 46/127, 146, 41, 87, 88; 124/64; 40/407

[56] References Cited

U.S. PATENT DOCUMENTS

| | | | |
|---|---|---|---|
| 672,277 | 4/1901 | Maull | 46/44 |
| 741,360 | 10/1903 | Moseley | 46/44 |
| 1,916,988 | 7/1933 | Pieschke | 46/87 X |

FOREIGN PATENT DOCUMENTS

| | | | |
|---|---|---|---|
| 484592 | 10/1929 | Fed. Rep. of Germany | 46/44 |

*Primary Examiner*—Louis G. Mancene
*Assistant Examiner*—Mickey Yu
*Attorney, Agent, or Firm*—Mason, Kolehmainen, Rathburn & Wyss

[57] ABSTRACT

A pop-up toy includes a base having an upstanding first stem, with a piston affixed to the end of the stem, a hollow body having a generally cylindrical bore mounted for upward and downward sliding movement on the first stem, a head portion including a second stem having a piston affixed to the lower end thereof, the stem being inserted through an aperture into the hollow body for upward and downward sliding movement. Also included is a flexible air impact bulb and conduit which communicate with the body so as to pressurize the interior of the hollow body to elevate the body upwardly on the stem of the base and to elevate the stem of the head portion upwardly of the body when the bulb is compressed by an impact.

7 Claims, 3 Drawing Figures

POP-UP TOY

BACKGROUND OF THE INVENTION

1. Field of the Invention

This invention relates to pop-up toys and in particular to pop-up toys having restricted upward and downward movement and which may be used by children of any age.

2. Brief Description of the Prior Art

There have been many toys in the past which had as their object the amusement of children via the use of pop-up heads or figures. Among these types of toys were the typical jack-in-the-box or the pneumatically launched rockets. These prior art toys however, did not develop a scheme whereby there was dual acting, relative movement between a base and a body, and between a head and the body.

Typical of these prior art references is Breslow U.S. Pat. No. 4,076,006. This toy includes a pneumatic launcher, a conduit, and a launching base in combination with a rocket-like projectile. When the pneumatic bulb is compressed the interior of the rocket-like structure is pressurized to project the rocket away from the base.

SUMMARY OF THE INVENTION

An object of the present invention is to provide an improved pop-up toy which is durable and entertaining. The present invention provides a pop-up toy having the appearance of a human being and includes a body having a central bore, a pair of apertured walls at opposite ends of the body and a pair of internal annular stop rings. The toy is supported with a base having a stem and pneumatic piston extending into a lower end of the body through the end wall and a head portion is mounted at the upper end of the body with a stem extending downwardly into the bore through the upper end wall. An impact bulb is formed to use sudden impact by the hand or foot, to force compressed air out of the impact bulb through a conduit into the main body of the toy. When compressed air is forced into the body, the body rises upwardly in relation to the base, and the head portion rises upwardly with respect to the body. Portions of the body and head are formed and decorated to appear as an individual riding a horse.

Other objects, features and advantages of the present invention will become apparent from the following detailed description taken in conjunction with the accompanying drawings.

DESCRIPTION OF THE PREFERRED EMBODIMENT

Figure 1:
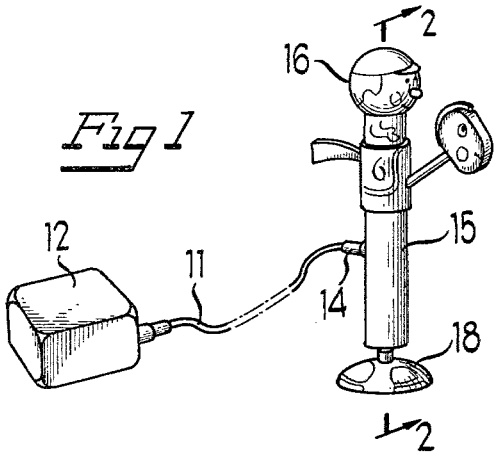
FIG. 1 is a perspective view of a pop-up toy made in accordance with the concepts of the present invention.

Referring to the drawings, and in particular to FIG. 1, there is illustrated a pop-up toy generally designated by the number 10, made in accordance with the concept of the present invention. Generally the toy is shaped to resemble or represent a human figure riding upon a horse-like creature and has a head portion 16 which represents the head of an individual. The upper portion of the body 15 is designed to appear as the body of a horse.

Figure 2:
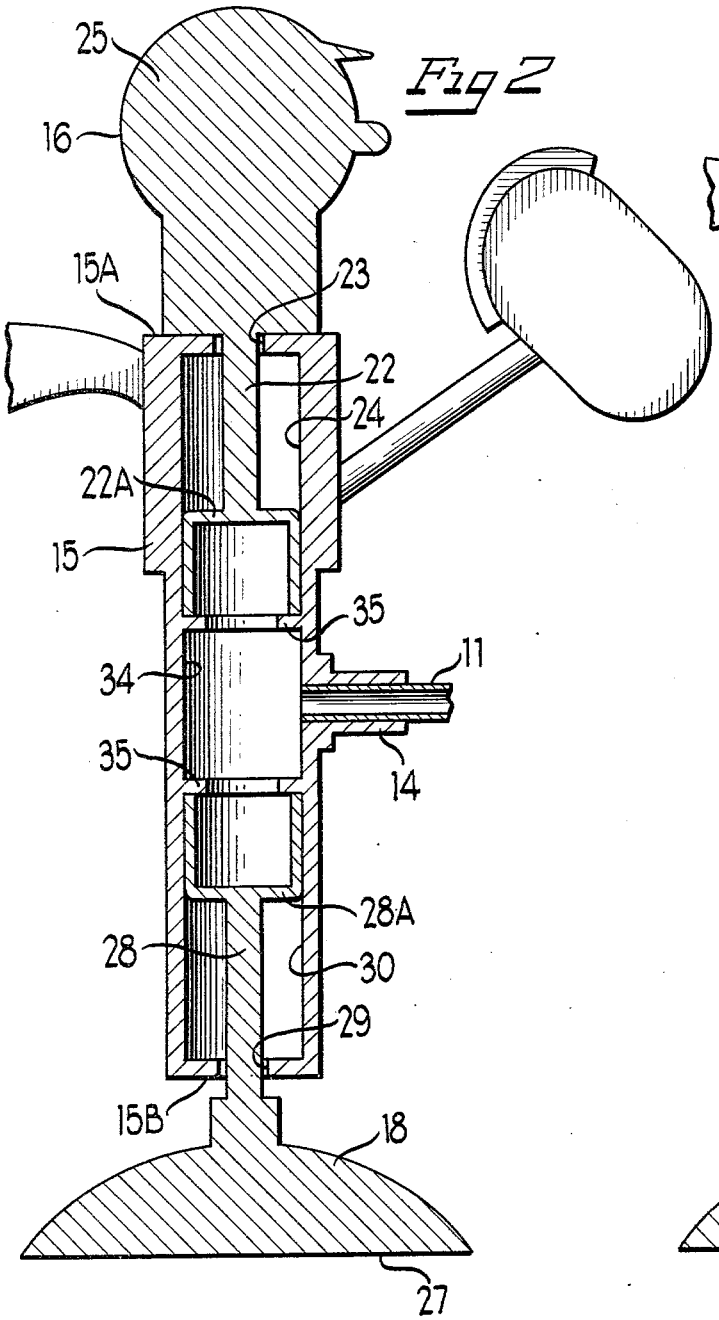
FIG. 2 is a vertical section taken generally along line 2—2 of FIG. 1.
Figure 3:
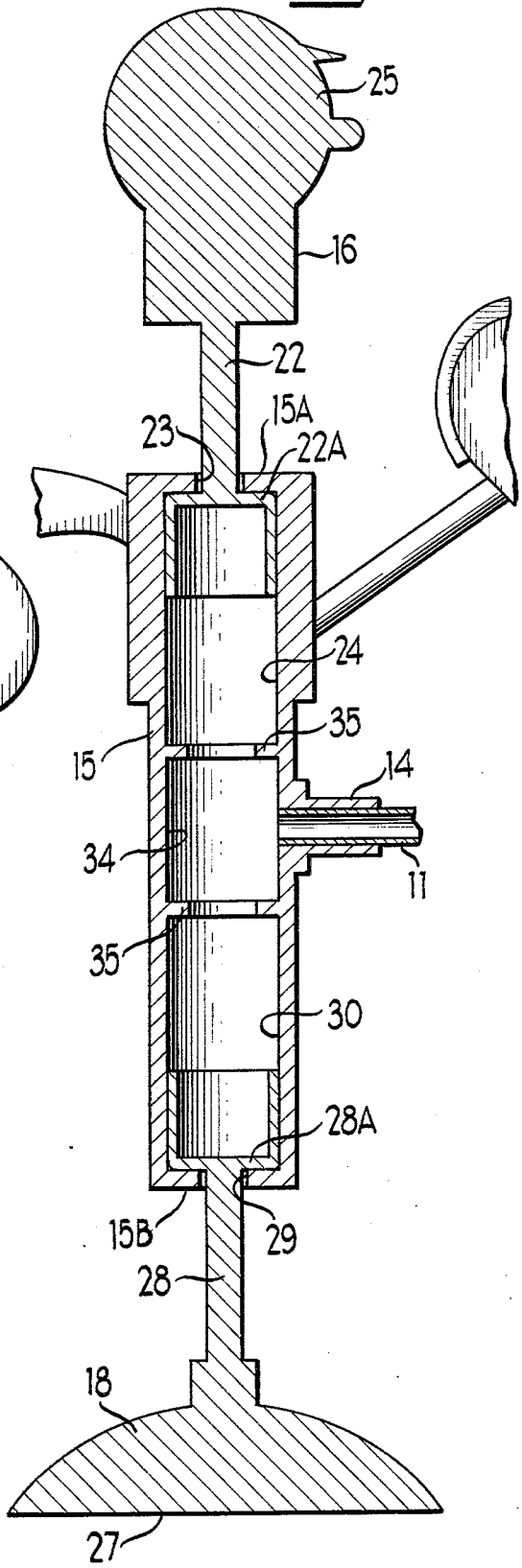
FIG. 3 is a vertical section of the apparatus of FIG. 2 but illustrating the toy in an expanded position.

Referring more particularly to FIGS. 2 and 3, the head portion 16 includes a generally cylindrical, depending neck 22 which extends into the body through an aperture 23 in an upper end wall 15A of the body which and integral therewith, is a piston 22A which is mounted for slidable movement within a generally cylindrical bore defining an upper chamber 24 of the body. The outside diameter of the piston 22A is slightly smaller than the diameter of the upper chamber 24 for smooth sliding movement between the head portion 16 and the body. The head portion 16 includes an eniarged head 25 above the stem 22, larger in diameter than aperture 23. When the toy is in the collapsed position of FIG. 2 the head 25 engages the upper end of the body to limit downward sliding movement of the head portion.

When the toy 10 is in the expanded position of FIG. 3 the upper end wall 15A acts as a stop to relative sliding movement by prohibiting further upward movement of the piston 22A. It should also be noticed that the annular stop flange 35 also acts as a stop to relative downward movement of the head portion 16 by engaging the piston 22A when in the collapsed position of FIG. 2.

The base portion 18 includes a wide base 27 for supporting the toy on a playing surface and an upwardly extending shaft 28 projects upwardly of the base into the body through an aperture 29 in a lower end wall 15B. At the upper end, the stem includes an integral piston 28A disposed for relative sliding movement in a lower chamber 30 of the body. Like the stop structures described above the body 15 includes a lower end wall 15B which prohibits further upward movement of the body 15 with relation to the base 18 by engaging the piston 28A as shown in FIG. 3.

The lower of a pair of vertically spaced apart annular stop flanges 35 which extend into the bore also provides a stop for limiting downward relative movement of the body on the base as shown in FIG. 2, when the flanges are engaged by the top of the piston 28A.

The body 15 includes a middle chamber 34 between the upper and lower chambers 24 and 30, and the middle chamber is separated from the upper and lower chamber by the pair of spaced apart annular stop flanges 35. These stop flanges are disposed on opposite sides of a nipple 14 connected to the outer end of the conduit 11. When the bulb 12 is compressed, air flows through the conduit 11 into the chamber 34 and this moves the upper and lower pistons 22A and 28A away from the annular stop flanges 35. As this occurs the head portion 16 moves upwardly relative to the body 15 and the body moves upwardly relative to the base 18 with a resultant pop-up action as illustrated in FIG. 3. In the position of FIG. 3 the upper piston 22A is engaged with the upper end wall 15A of the body and the lower piston 28A is engaged with the lower end wall 15B.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent is:

1. A pop-up toy comprising:

a base including an upstanding first stem;

a hollow body having a generally cylindrical bore, mounted for upward and downward sliding movement on said first stem;

a head portion including a second stem extending downwardly into said hollow body mounted for upward and downward sliding therein;

means for pressurizing the interior of said hollow body to elevate said body upwardly on said first stem and elevate said second stem of said head portion upwardly of said body:

means for limiting relative sliding movement between said body and said base including an end wall on the bottom of said body having an aperture for receiving the stem of said base; and second means for limiting relative sliding movement between said body and said head portion including an end wall on top of said body having an aperture for receiving the stem of said head portion.

2. A pop-up toy comprising:

a base including an upstanding first stem;

a hollow body having a generally cylindrical bore, mounted for upward and downward sliding movement on said first stem;

a head portion including a second stem extending downwardly into said hollow body mounted for upward and downward sliding therein;

means for pressurizing the interior of said hollow body to elevate said body upwardly on said first stem and elevate said second stem of said head portion upwardly of said body;

at least one of said first and second stems including a piston on said stem mounted for sliding movement in said bore; and an internal stop in said bore engaging said piston for limiting relative sliding movement between said body and said base or said head portion.

3. The apparatus of claim 2, wherein said body includes a pair of spaced apart internal stops for limiting relative sliding movement between said body and said head portion and said body and said base.

4. A pop-up toy comprising:

a base including an upstanding first stem;

a hollow body having a generally cylindrical bore, mounted for upward and downward sliding movement on said first stem;

a head portion including a second stem extending downwardly into said hollow body mounted for upward and downward sliding therein;

means for pressurizing the interior of said hollow body to elevate said body upwardly on said first stem and elevate said second stem of said head portion upwardly of said body; and means for limiting relative sliding movement between said head and said base with the body, said means including a pair of end caps and a pair of internal flanges.

5. The apparatus of claim 4, wherein said head portion includes an enlarged portion above said stem shaped to resemble the head of an animated object.

6. The apparatus of claim 5, wherein said head portion includes a stop surface adjacent a lower end of said enlarged portion engageable with an upper end of said body when said head portion is in a lower position thereon.

7. The apparatus of claim 4, wherein said body includes a decorative element shaped to resemble an animal being ridden.

* * * * *